US006152054A

United States Patent [19]

Ashworth et al.

[11] Patent Number: 6,152,054

[45] **Date of Patent: *Nov. 28, 2000**

[54] METHOD AND SYSTEM FOR THE DISPOSAL OF COAL PREPARATION PLANT WASTE COAL THROUGH SLURRY CO-FIRING IN CYCLONE-FIRED BOILERS TO EFFECT A REDUCTION IN NITROGEN OXIDE EMISSIONS

[75] Inventors: Robert A. Ashworth, Wooster, Ohio; W. Richard Carson, Chattanooga, Tenn.; Todd A. Melick; Todd M. Sommer, both of Dalton, Ohio

[73] Assignee: GE Energy and Environmental Research Corp., Irvine, Calif.

[ * ] Notice: This patent is subject to a terminal disclaimer.

[21] Appl. No.: 09/410,415

[22] Filed: Oct. 1, 1999

Related U.S. Application Data

[63] Continuation of application No. 08/898,146, Jul. 22, 1997, Pat. No. 5,988,081.

[51] Int. Cl.[7] ..... F23B 7/00; F23D 1/02

[52] U.S. Cl. ..... 110/345; 110/346; 110/347; 110/233; 110/238; 110/263; 110/266; 110/264

[58] Field of Search ..... 110/264, 265, 110/266, 346, 347, 348, 233, 234, 238, 243, 244, 260, 261, 262, 263, 165 A, 345

[56] References Cited

U.S. PATENT DOCUMENTS

| | | | |
|---|---|---|---|
| 2,678,615 | 5/1954 | Söderlund et al. | 110/7 |
| 3,124,086 | 3/1964 | Sage et al. | 110/7 |
| 3,396,681 | 8/1968 | Hubbard | 110/8 |
| 3,421,824 | 1/1969 | Herbst | 431/10 |
| 3,500,775 | 3/1970 | Hubbard | 110/8 |
| 3,589,314 | 6/1971 | Tratz et al. | 110/28 |
| 3,837,303 | 9/1974 | Baardson | 110/8 |
| 3,861,330 | 1/1975 | Santoleri | 110/7 |
| 3,892,190 | 7/1975 | Sharpe | 110/8 |
| 3,900,554 | 8/1975 | Lyon | 423/235 |
| 4,208,386 | 6/1980 | Arand et al. | 423/235 |
| 4,325,924 | 4/1982 | Arand et al. | 423/235 |
| 4,335,084 | 6/1982 | Brogan | 423/235 |

(List continued on next page.)

FOREIGN PATENT DOCUMENTS

| | | | |
|---|---|---|---|
| 1-284382 | 11/1989 | Japan | 344/110 |
| 1537961 | 1/1990 | U.S.S.R. | 238/110 |

OTHER PUBLICATIONS

Morrison, D.K, et al., "Coal–Water Shurry Reburning for Nox Emmission Control," Proceedings of the 20th International Technical Conference on Coal Utilization & Fuel Systems, Clearwater, Florida, USA, pp. 47–58, Mar. 1995.

Ashworth, R.A., et al., "Coal Fines Utilization Technologies," Proceedings of the 20th International Technical Conference on Coal Utilization & Fuel Systems, Clearwater, Florida, USA, pp. 559–570, Marc 1995.

Lyon, Richard K. and Hardy, James E., "Dicovery and Development of the Thermal De Nox Process," Exxon Res. and Eng. Co., Reprinted from I&EC Fundamentals, vol. 25, No. 1, pp. 19–24, 1986 (No Month).

(List continued on next page.)

*Primary Examiner*—Stephen Gravini
*Assistant Examiner*—Ken B. Rinehart
*Attorney, Agent, or Firm*—Workman, Nydegger & Seeley

[57] ABSTRACT

A method and system for the use of waste coal fines to reduce nitrogen oxides emissions from a coal-fired cyclone boiler. A coal water slurry including waste coal fines is injected as a co-firing fuel into a cyclone barrel of the cyclone boiler to partially oxidize the coal water slurry in a central portion of the cyclone barrel where injected. This produces a reducing zone having reducing gas species that convert nitrogen oxides to diatomic nitrogen. The coal water slurry can alternatively be injected into the cyclone barrel from a secondary combustion air conduit. The evaporation of the water from the coal water slurry reduces the overall combustion temperature in the cyclone barrel, further reducing the production of nitrogen oxides.

30 Claims, 4 Drawing Sheets

U.S. PATENT DOCUMENTS

| | | | |
|---|---|---|---|
| 4,403,941 | 9/1983 | Okiura et al. | 431/10 |
| 4,444,126 | 4/1984 | Förster | 110/238 |
| 4,465,495 | 8/1984 | Scheffee | 44/51 |
| 4,785,746 | 11/1988 | Roy et al. | 110/347 |
| 4,800,825 | 1/1989 | Kuenzly | 110/345 |
| 4,851,201 | 7/1989 | Heap et al. | 423/235 |
| 4,861,567 | 8/1989 | Heap et al. | 423/235 |
| 4,886,519 | 12/1989 | Hayes et al. | 44/51 |
| 4,920,898 | 5/1990 | Solbes et al. | 110/265 |
| 5,052,312 | 10/1991 | Rackley et al. | 110/346 |
| 5,078,064 | 1/1992 | Breen et al. | 110/212 |
| 5,116,584 | 5/1992 | Chen et al. | 423/235 |
| 5,139,755 | 8/1992 | Seeker et al. | 423/235 |
| 5,224,334 | 7/1993 | Bell | 60/274 |
| 5,231,937 | 8/1993 | Kobayashi et al. | 110/262 |
| 5,270,025 | 12/1993 | Ho et al. | 423/235 |
| 5,272,820 | 12/1993 | Ito et al. | 34/57 |
| 5,307,746 | 5/1994 | Khinkis et al. | 110/245 |
| 5,380,342 | 1/1995 | Leonard, III et al. | 44/280 |
| 5,443,805 | 8/1995 | Beér et al. | 423/235 |
| 5,513,583 | 5/1996 | Battista | 110/261 |
| 5,544,598 | 8/1996 | Guibelin et al. | 110/238 |
| 5,685,153 | 11/1997 | Dickinson et al. | 60/648 |
| 5,690,039 | 11/1997 | Monro et al. | 110/264 |
| 5,746,144 | 5/1998 | Breen et al. | 110/345 |
| 5,890,442 | 4/1999 | Holmes et al. | 110/345 |
| 5,908,003 | 6/1999 | Hura et al. | 110/345 |

OTHER PUBLICATIONS

Miller, James A. and Bowman, Craig T., "Mechanism and Modeling of Nitrogen Chemistry in Combustion," Prog. Energy Combust. Sci., vol. 15, pp. 287–338, 1989 (No Month).

Chen, S. L., et al., "Advanced Non–Catalytic Post Combustion NOx Control," Environmental Progress, vol. 10, No. 3, pp. 182–185, Aug. 1991.

Elliott, Martin A. (Ed.), "Chemistry of Coal Utilization," Prepared under the Guidance of the Committee on Chemistry of Coal Utilization, Second Supplementary Volume, pp. 1272–1277, John Wiley & Sons, 1981 (No month).

Eckhart, C.F. and DeVault, R.F., "Cyclone Reburn Using Coal–Water Fuel: Pilot Scale Development and Testing," Report DOE/PC/90157–1, Sponsored by U.S. Dept. of Energy and Pittsburgh Energy Technology Center, The Babcock & Wilcox Company, Oct. 1991.

Gullet, Brian K., et al., "Furnace Shurry Injection for Simultaneous $SO_2/NO_X$ Removal," The 1991 $SO_2$ Control Symposium, vol. 2: Sessions 5A–6B, pp. 87–103, Dec. 306, 1991.

Hsieh, B.C., et al., "An Analysis of Chemistry and Mechanisms for High Temperature Desulfurization of Low BTU Gas When Using Lime or Limestone," Gilbert Associates, Inc., 1974 (No month).

METHOD AND SYSTEM FOR THE DISPOSAL OF COAL PREPARATION PLANT WASTE COAL THROUGH SLURRY CO-FIRING IN CYCLONE-FIRED BOILERS TO EFFECT A REDUCTION IN NITROGEN OXIDE EMISSIONS

This application is a continuation of U.S. patent application Ser. No. 08/898,146, filed Jul. 22, 1997, now U.S. Pat. No. 5,988,081.

BACKGROUND OF THE INVENTION

1. The Field of the Invention

The present invention relates to techniques for the disposal of coal fines and/or coarse coal refuse from conventional coal preparation plants. More particularly, the present invention relates to an improved method and system for the disposal of waste coal products in the form of low cost, low density coal water slurry by co-firing the slurry in cyclone-fired boilers in such a manner as to effect a reduction in nitrogen oxides emissions, thereby minimizing landfill requirements and improving the fuel recovery efficiency of coal preparation plants.

2. The Relevant Technology

The use of coal water slurry as a fuel is well known, but historically in the United States, with minor exceptions, the use of coal water slurry has been confined primarily to demonstration projects. The disadvantages of using coal water slurry in the past have been related to the energy required to evaporate the water in the slurry, and the relatively high price of preparing and transporting a high coal density (65% plus coal) coal water slurry fuel. However, with new coal recovery techniques, waste coal from coal preparation plants that has been impounded in ponds or in coarse refuse piles may now be recovered economically and prepared as coal water slurry fuels. The recovered coal water slurry fuel in most cases will be less expensive than the processed coal sold from these preparation plants.

It is estimated that two to four billion tons of coal fines are impounded in ponds throughout the United States, with coarse refuse doubling the total coal portion ending up as waste products from these coal preparation plants. These waste materials are an environmental liability for the coal preparation plant operators and are a lost fuel source.

Various techniques have been developed previously to utilize coal/water mixtures in combustion systems. For example, in U.S. Pat. No. 3,589,314 to Tratz et al., a method and device for pressure spraying and burning a 60/40 weight ratio coal dust/water mixture is described. Complete combustion of the coal dust/water mixture in a furnace is accomplished by heating the mixture under pressure prior to spraying the mixture through a nozzle with radial or axial bores into a combustion chamber. Additionally, U.S. Pat. No. 4,444,126 to Forster describes an apparatus for combustion of a suspension of coal particles in water, in which combustion air preheated to 550° C. (1022° F.) is forced into a coal water slurry preheated to 100° C. (212° F.) in a portion of the burner upstream of the burner flame. In U.S. Pat. No. 4,465,495 to Scheffee, a process is disclosed for making a high heating value coal water slurry fuel that can be injected directly into a furnace as a combustible fuel for the express purpose of replacing fuel oil in oil-fired boilers.

Furthermore, U.S. Pat. No. 5,380,342 to Leonard et al. describes a process of co-firing coal water slurry specifically in a gas fired boiler through wall-fired gas burners. The furnace is preheated using natural gas and is then fired with approximately 60% of the heat input supplied by pulverized coal and 40% of the heat input supplied by natural gas. The gas is gradually shut off completely while coal water slurry is added such that the heat input ratio of pulverized coal to coal water slurry is 80/20. The process of this patent is specifically directed to a modified gas fired boiler wherein the burners are designed to fire three fuels: natural gas, coal water slurry, and pulverized coal. Further, when co-firing in wall fired units, most of the ash produced from coal combustion (some 80%) is carried out of the boiler with the flue gas. This means that the ash content of the slurry must be kept at a minimal level, since gas fired units are not equipped to handle fly ash.

In U.S. Pat. No. 5,513,583 to Battista, a coal water slurry burner assembly is disclosed in which a metal tube for conveying a suspension of fine-grained coal in a liquid or aqueous slurry is inserted through a conventional air burner for combustion of pulverized coal. The metal tube is attached to a nozzle oriented and adapted to conically spray the aqueous slurry into the pulverized coal fueled flame of the burner.

The methods disclosed in the above patents accomplish their intended purpose to facilitate the combustion of coal water slurry in fossil fuel-fired boilers, but are not methods specifically designed to eliminate waste coal products from coal preparation plants or to minimize nitrogen oxides emissions. An improved process is needed that will allow for the beneficial use of all preparation plant waste coal by-products as fuels, eliminating the environmental impact of landfilling, and also providing a technique to effect up to 100% fuel recovery efficiency for coal preparation plants.

SUMMARY AND OBJECTS OF THE INVENTION

The present invention is directed to an economical method and system for the use of coal preparation plant waste coal by-products. The coal by-products are prepared as a low cost, low density coal/water slurry fuel, and are co-fired in a cyclone-fired boiler. Further, the invention includes a technique wherein the coal water slurry is fired in such a manner as to effect a reduction of nitrogen oxides emissions from cyclone-fired boilers. The coal water slurry co-firing technique of the invention may be easily retrofitted to existing industrial and electric utility cyclone-fired boilers, and may also be applied to new boiler installations.

In one aspect of the present invention, a method for disposal of waste coal fines and reduction of nitrogen oxides emissions from a coal-fired cyclone boiler is provided. A coal water slurry spray is injected as a co-firing fuel into a cyclone barrel of the cyclone-fired boiler. The coal water slurry is injected and fired at a rate to provide from about 5 to about 40 percent of the total heat input into the cyclone barrel and in such a manner as to lower the temperature of the cyclone barrel to effect reduction of thermal nitrogen oxides formation.

In a first injection option, the coal water slurry spray can be injected such that the spray is oriented at an angle of about 0° to about 90° from an axial centerline of the cyclone barrel. A reducing zone is created in a central portion of the cyclone barrel where the coal water slurry is injected to effect reduction of fuel-bound nitrogen oxides formation. In a second injection option, the coal water slurry spray can be injected from a secondary combustion air conduit into the cyclone barrel in generally the same direction as the secondary air flow stream flowing into the cyclone barrel. The spray is oriented at an angle of about 0° to about 90° from an axial centerline of the secondary combustion air conduit. In a third injection option, the coal water slurry spray can be injected simultaneously according to the first and second injection options into the cyclone barrel.

In another aspect of the present invention, a system for disposal of waste coal fines and reduction of nitrogen oxides emissions from a coal-fired cyclone boiler includes means for directing a coal water slurry as a co-firing fuel into a cyclone barrel of the cyclone-fired boiler. An injection means is provided in the system for introducing a coal water slurry spray into the cyclone barrel. The injection means produces a spray that can be oriented at various angles into the cyclone barrel as discussed above. In one embodiment, the system of the invention includes a storage tank for holding a coal water slurry, and a slurry pump in communication with the storage tank. The slurry pump directs the coal water slurry to the injection means for introducing the coal water slurry spray into the cyclone barrel.

The injection means can be employed in various optional configurations so that the coal water slurry spray can be injected according to the first, second, or third injection options as discussed above. The injection means can be a dual-fluid atomizer nozzle that uses an atomizing medium to spray the coal water slurry into the cyclone barrel. The atomizing medium used can be selected from the group of air, steam, natural gas, or mixtures thereof. The injection means can also be a mechanical atomizer nozzle that atomizes the coal water slurry injected into the cyclone barrel.

The coal water slurry can be produced from coal preparation plant pond impoundments, using either unprocessed high ash-containing coal fines comprising at least about 30 weight percent, and preferably from about 30 to about 60 weight percent ash on a dry basis, or processed coal fines reduced in ash content to less than about 20 weight percent, and preferably from about 10 to about 20 weight percent on a dry basis. The coal water slurry can also be produced from other sources such as processed coal from coal preparation plant coarse refuse.

Accordingly, a principle object of the present invention is to provide an economical method and system for the use of coal preparation plant waste coal by-products.

Another object of the invention is to provide a technique wherein coal water slurry is fired in such a manner as to effect a reduction of nitrogen oxides emissions from cyclone-fired boilers.

A further object of the invention is to provide a coal water slurry co-firing technique that may be easily retrofitted to existing industrial and electric utility cyclone-fired boilers, or applied to new boiler installations.

These and other objects and features of the present invention will become more fully apparent from the following description and appended claims, or may be learned by the practice of the invention as set forth hereinafter.

BRIEF DESCRIPTION OF THE DRAWINGS

In order to more fully understand the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE INVENTION

Figure 1:
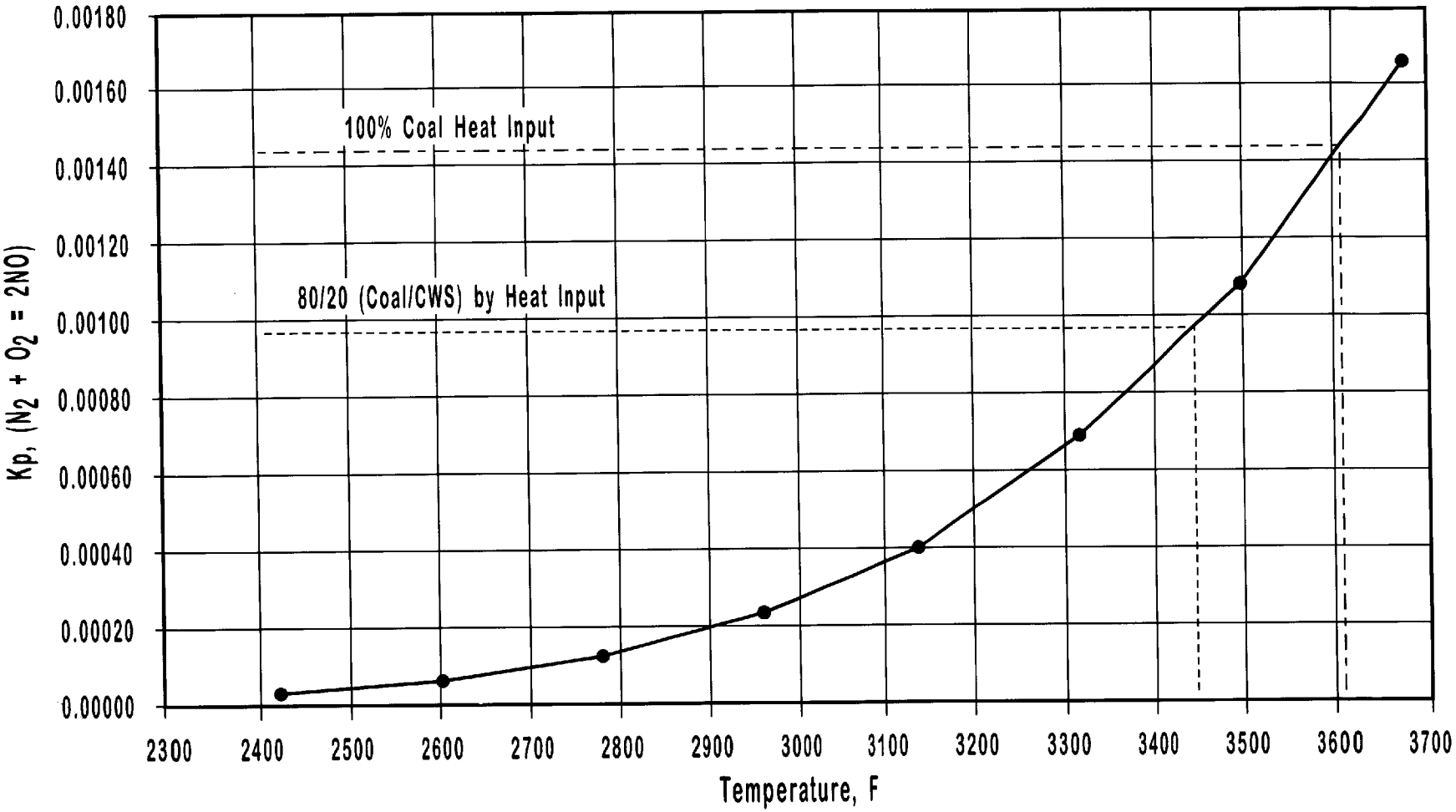
FIG. 1 is a graph showing the equilibrium coefficients for thermal nitric oxide (NO) production as a function of temperature.

The present invention is directed to an improved method and system for the disposal of waste coal products from coal preparation plants by preparing such wastes into a coal water slurry (CWS) fuel that may be fired in cyclone boilers. The invention provides an economical method and system for the use and disposal of coal preparation plant waste coal by-products. The coal by-products are prepared as a low cost, low density coal/water slurry fuel (e.g., 50/50 coal/water), and are co-fired in a coal-fired cyclone boiler. The coal water slurry is fired in such a manner as to effect a reduction of nitrogen oxides emissions from the cyclone boiler. The present invention thus provides for the disposal of coal waste products and simultaneously the reduction of nitrogen oxides emissions in cyclone-fired units. The coal water slurry co-firing system for disposal of waste coal by-products and for reducing $NO_X$ emissions may be easily retrofitted to existing industrial and electric utility coal-fired cyclone boilers, and may also be applied to new boiler installations.

In a method for disposal of waste coal fines and reduction of nitrogen oxides emissions from a coal-fired cyclone boiler according to the present invention, a coal water slurry spray is introduced as a co-firing fuel into a cyclone barrel of the cyclone-fired boiler with an injection means. Non-limiting examples of the injection means include a dual-fluid atomizer nozzle that uses an atomizing medium to spray the coal water slurry, and a mechanical atomizer nozzle that atomizes the coal water slurry without a separate atomizing medium. The atomizer nozzles used herein preferably produce a solid conical spray having an angle of about 15° to about 30° from a centerline of the spray.

In a first injection option, the injection means produces a coal water slurry spray oriented at an angle of about 0° to about 90°, preferably at an angle of about 45° to about 80°, from an axial centerline of the cyclone barrel. The spray angle is measured from the axial centerline to the centerline of the spray. The coal water slurry is injected and fired at a rate to provide from about 5 to about 40 percent of the total heat input into the cyclone barrel, preferably at a rate to provide from about 15 to about 30 percent of the total heat input, and in such a manner as to lower the temperature of the cyclone barrel to effect reduction of thermal nitrogen oxides formation. If the cyclone boiler must operate at a higher temperature because of slag fluidity considerations, the excess air directed into the cyclone barrel may be reduced. The lower partial pressure of oxygen in the cyclone barrel then will also have the effect of reducing thermal $NO_X$ emissions. The reason for this is that like lower temperatures, lower oxygen partial pressure also reduces thermal $NO_X$ emissions in accord with the equilibria from the following reaction: $N_2+O_2 \rightarrow 2NO$, where the equilibria constant $Kp=[NO_2]^2/[N_2][O_2]$. A reducing zone is created in a central portion of the cyclone barrel where the coal water slurry is injected to effect reduction of fuel-bound nitrogen oxides formation. The injection of the coal water slurry into the cyclone-fired boiler according to the first injection option partially oxidizes the coal water slurry in a central portion of the cyclone barrel, thereby producing the reducing zone having reducing gas species that convert nitrogen oxides to diatomic nitrogen. The evaporation of the water from the coal water slurry reduces the overall combustion temperature in the cyclone barrel somewhat to further reduce the production of nitrogen oxides.

In a second injection option, the coal water slurry spray can be injected from a secondary combustion air conduit into the cyclone barrel in generally the same direction as the secondary air flow stream flowing into the cyclone barrel. In the second injection option, the coal water slurry spray can be oriented at an angle of about 0° to about 90° from an axial centerline of the secondary combustion air conduit, with the spray angle measured from the axial centerline to the centerline of the spray. Preferably, the injection means produces a spray introduced with the cyclone secondary air flow at the air entry point into the cyclone barrel and oriented axially with the air flow to about 45° downward from the flow, or more preferably from about 0° to about 20° downward from the flow. With this technique, the coal water slurry primarily follows the flow pattern of the secondary air. The water evaporation plus partial coal slurry combustion creates a cooler temperature and lower oxygen concentration at the cyclone barrel wall prior to contact with the incoming primary coal feed. The combination of cooler temperature and lower oxygen concentration has the effect to reduce $NO_X$ emissions.

In a third injection option, the coal water slurry spray can be injected simultaneously according to the first and second injection options into the cyclone barrel, although this is less preferred than either of the first or second injection options.

Oxides of nitrogen are produced primarily from thermal conditions of high temperature under oxidizing flue gas conditions such as that found with conventional coal-fired cyclone boilers, and from fuel-bound nitrogen. The higher the temperature and the greater the oxygen content of the flue gas, the greater the production of nitrogen oxides.

Under normal excess air coal combustion conditions in a coal-fired cyclone boiler, the temperature in the cyclone barrel is very hot, typically about 3000° F. or greater, and the conditions are right for the production of relatively high levels of nitrogen oxides (e.g., about 1 to 2 lbs $NO_X/10^6$ BTU of coal fired). Table 1 shows the ultimate fuel analysis of a typical coal feed for a cyclone boiler, the higher heating value (HHV), and the combustion temperature for normal excess air conditions. Shown for comparison is the blended coal analysis wherein 80% of the heat input is supplied by the base coal and 20% of the heat input is supplied by preparation plant waste coal fines, in a coal water slurry form that contains 50% water and 15% ash. Also shown is the HHV and the combustion temperature of the blend.

TABLE 1

Fuel Analyses and Combustion Temperatures (Flue gas @ 3 vol-% $O_2$, wet basis)

| Ultimate Analysis, wt-% | Base Coal | Coal/CWS (80/20) Blend |
|---|---|---|
| Carbon | 69.57 | 54.20 |
| Hydrogen | 4.85 | 3.78 |
| Oxygen | 5.43 | 4.23 |
| Nitrogen | 1.44 | 1.12 |
| Sulfur | 2.78 | 2.17 |
| Ash | 8.33 | 10.86 |
| Moisture | 7.60 | 23.64 |
| Total | 100.00 | 100.00 |
| HHV, BTU/lb | 12,477 | 9,810 |
| Combustion Temp. ° F. | 3606 | 3458 |

The equilibrium coefficients for thermal nitric oxide (NO) production is shown as a function of temperature in the graph of FIG. 1. As a result of adding more water to the fuel when co-firing the coal with CWS in an 80/20 blend, the combustion temperature is reduced and the equilibrium coefficient for nitric oxide (NO) production is reduced. Therefore, less NO will be formed by utilizing the present invention in a cyclone boiler. According to the equilibrium values, the NO production will be reduced from about 15 to about 20%.

In a cyclone-fired boiler, the coal and air are introduced tangentially into cyclone barrels to create a cyclone effect. Coal and air are swirled toward the wall of the cylindrical cyclone barrel where coal combustion takes place through rapid coal/air mixing. When coal and air are swirled in this manner, a zero pressure or still zone is created in a central portion of the cyclone barrel, with little air flow passing into the center of the swirl. In the first injection option according to the present invention, the CWS is injected into and co-fired in this still zone to create a slightly reducing condition in the center of the cyclone barrel as the coal in the slurry undergoes partial oxidation, thereby forming a high temperature reducing zone. Under the reducing conditions in the reducing zone, the nitrogen oxides created in large part by the fuel-bound nitrogen will be reduced to diatomic nitrogen through reactions with reducing gas species such as CH, CO and $H_2$. When the combustion gases containing nitrogen oxides are contacted with the reducing gas species, from about 5 to about 40 percent of the $NO_X$ in the combustion gases is converted to diatomic nitrogen according to the following example equations:

$$[CH_2]^{++}+2NO \rightarrow CO+H_2O+N_2; \quad (1)$$

$$2CO+2NO \rightarrow 2CO_2+N_2; \text{ and} \quad (2)$$

$$2H_2+2NO \rightarrow 2H_2O+N_2. \quad (3)$$

Figure 2:
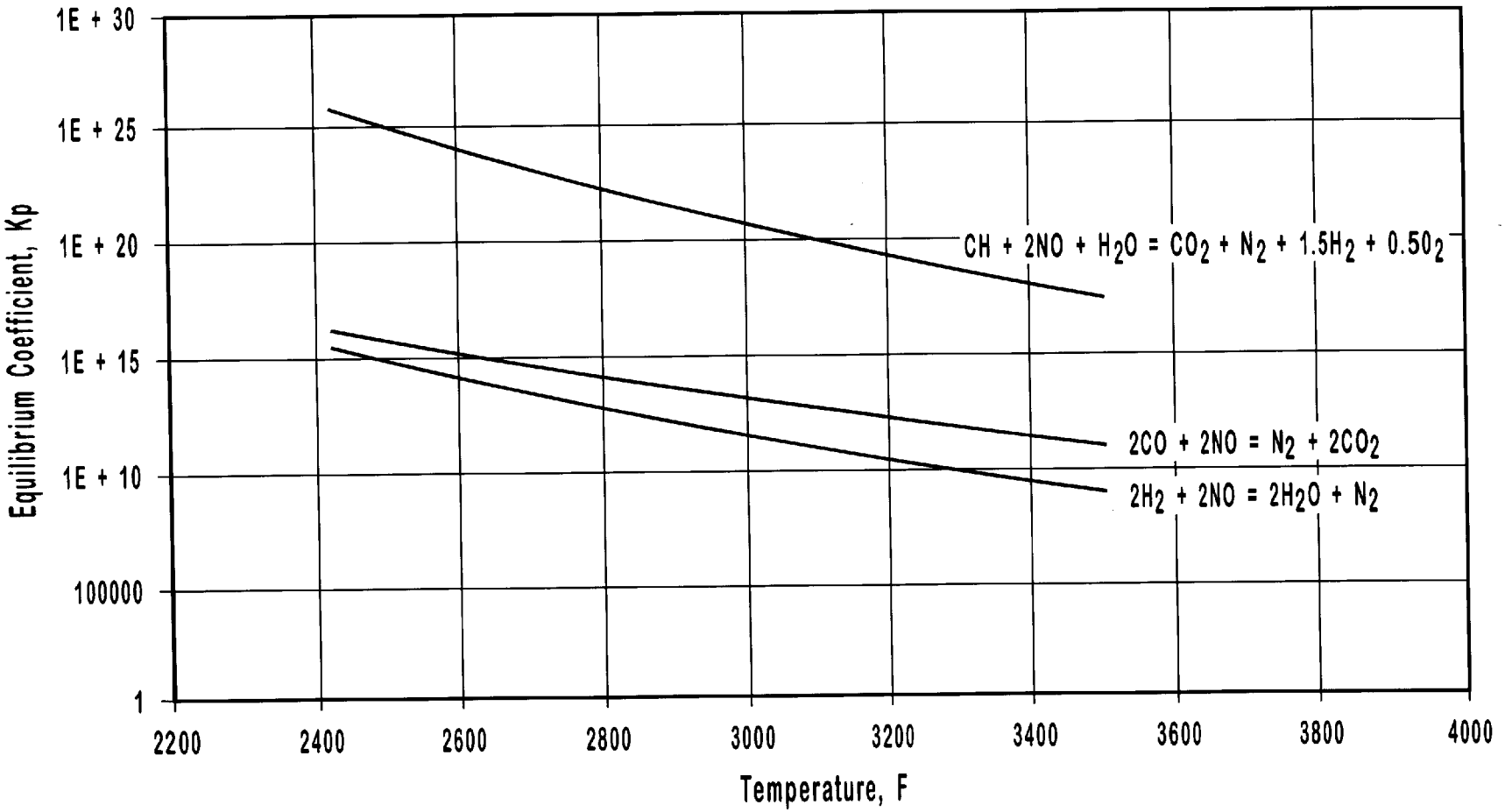
FIG. 2 is a graph showing the equilibrium coefficients, as a function of temperature, for reactions that reduce NO production.

FIG. 2 is a graph showing the equilibrium coefficients, as a function of temperature, of the reactions that will occur in the high temperature reducing zone from the combustion of the CWS to reduce the production of nitrogen oxides.

Under normal cyclone operation it is desirable to keep the molten slag produced in the cyclone in an oxidized form to reduce the rate of refractory erosion. The first injection option of co-firing CWS, although creating a reducing condition in the center of the cyclone, will not affect the oxidizing condition of the cyclone slag at the barrel wall. The reducing gases created in the center of the cyclone, as they travel radially outward will be completely oxidized by the swirling combustion air upon approaching the wall of the cyclone barrel.

Thus, the co-firing of coal water slurry in a cyclone boiler according to the present invention has two effects to reduce the production of $NO_X$, one is the lowering of the flame temperature which reduces thermal $NO_X$ production, and the other is the creation of a reducing zone which will reduce the production of fuel-bound nitrogen oxides.

In the second injection option for CWS co-firing, temperature and oxygen concentration reduction in the hottest zone of the cyclone barrel will have the effect to reduce $NO_X$ emissions.

One criterion that must be considered when co-firing coal with a different ash composition and/or the lowering of cyclone temperature due to water evaporation is the effect on the molten ash fluidity as determined by standard $T_{250}$ (temperature at which the slag viscosity is 250 poise) and $T_{10}$ (temperature at which the slag viscosity is 10 poise) calculations. If the molten ash viscosity is too high for proper slag flow, in most cases, a small amount of a basic material such as limestone, dolomite, or mixtures thereof, may be added to the coal water slurry to increase the fluidity of the slag produced in the cyclone barrel. Optionally, the overall excess air added to the cyclone barrel can be reduced to maintain a higher temperature to aid in slag flow.

A system according to the present invention, for disposal of waste coal fines and reduction of nitrogen oxides emissions from a coal-fired cyclone boiler, includes means for directing a coal water slurry as a co-firing fuel to a cyclone barrel of the cyclone boiler, and an injection means for introducing a coal water slurry spray into the cyclone barrel. In one embodiment, the directing means includes a storage tank for holding a coal water slurry, and a slurry pump in fluid communication with the storage tank and the injection means. The injection means is in communication with the slurry pump and the cyclone barrel, such that the slurry pump directs the coal water slurry to the injection means for producing a coal water slurry spray that can be oriented at various angles into the cyclone barrel as described above for the injection options. The injection means can be employed in various optional configurations, discussed in greater detail below, so that the coal water slurry spray can be injected according to the first, second, or third injection options discussed above.

The injection means projects the coal water slurry spray into the cyclone barrel, and the coal water slurry is fired at a controlled rate to provide from about 5 to about 40 percent of the total heat input into the cyclone barrel. The injected coal water slurry also lowers the temperature in the cyclone barrel to effect reduction of thermal nitrogen oxides formation. Under the first injection option, a reducing zone is also created in a central area of the cyclone barrel where the coal water slurry is injected, thus additionally effecting reduction of fuel-bound nitrogen oxides formation in the combustion gases. The concentration of nitrogen oxides in the combustion gases can be reduced in an amount from about 10 to about 30 percent by utilizing the techniques of the present invention.

Figure 3:
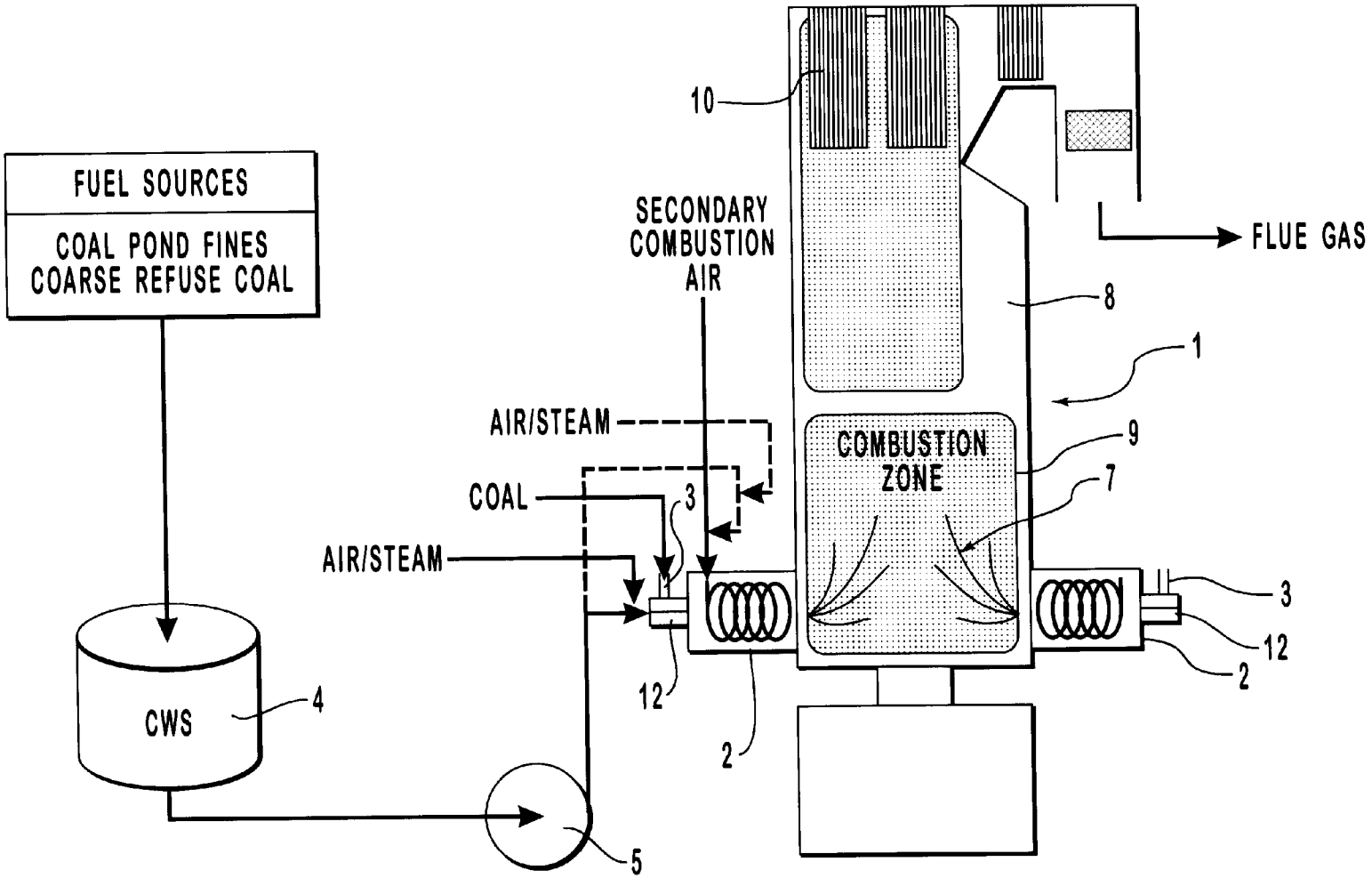
FIG. 3 is a process flow diagram depicting a system for the reduction of nitrogen oxides emissions from the combustion of coal, wherein coal water slurry is used as a co-firing fuel in a coal-fired cyclone boiler, with alternate injection options for coal water slurry co-firing being provided.
Figure 4:
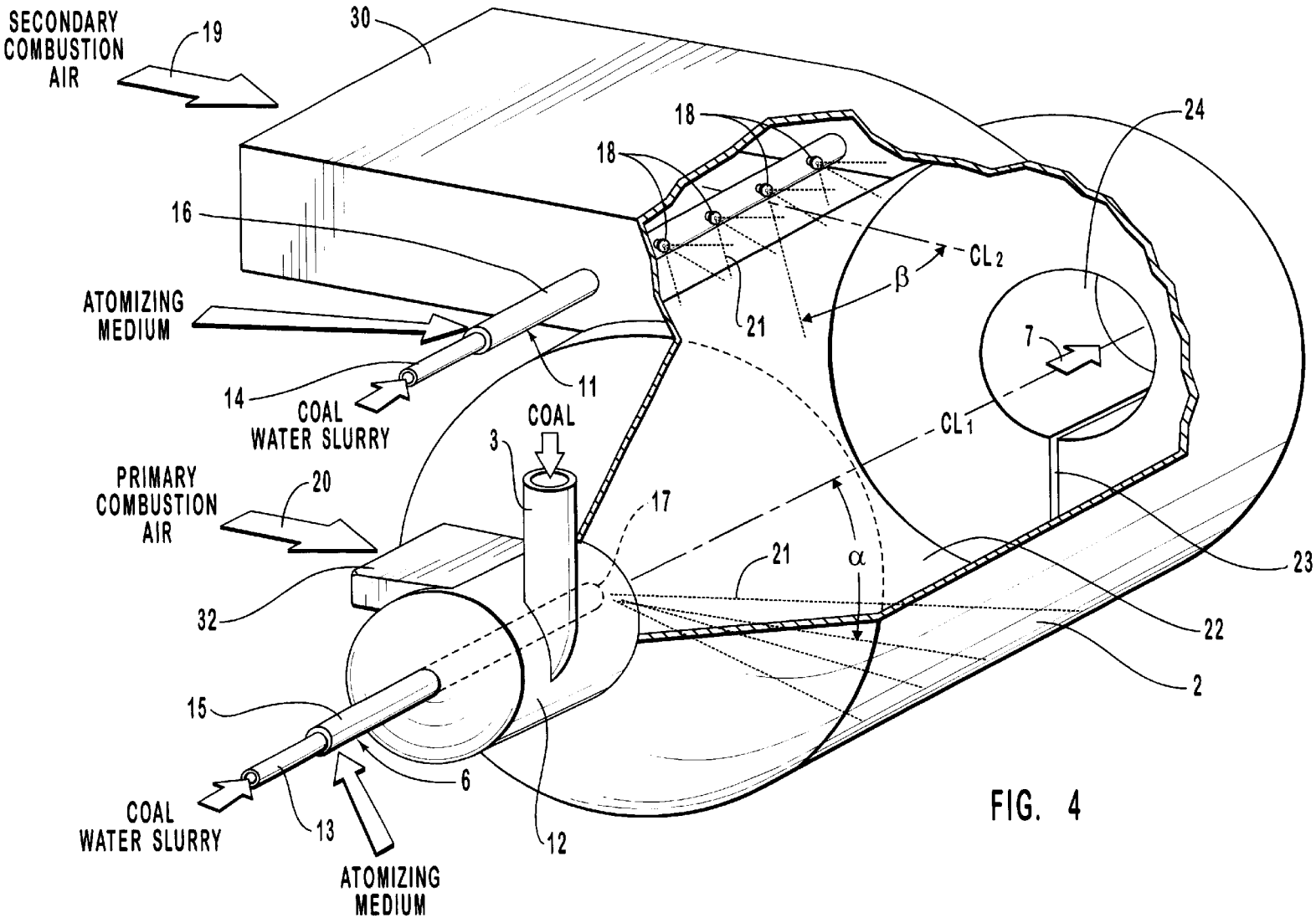
FIG. 4 is a partial perspective view of a cyclone barrel that can be used in the system depicted in FIG. 3.

In more detail, assuming ground coal to be the primary fuel for a cyclone-fired boiler and a prepared coal water slurry to be a supplemental fuel to be co-fired with the ground coal, FIG. 3 depicts a process flow diagram of a system for carrying out the method of the invention, while FIG. 4 shows a partial perspective view of a cyclone barrel that can be utilized in the system of the invention. The depicted system reduces nitrogen oxide emissions from the combustion of coal by using a coal water slurry as a co-firing fuel in the cyclone barrel.

Referring to FIG. 3, the cyclone boiler 1 includes the cyclone barrel(s) 2 and a boiler furnace 8. Ground coal, nominally less than about ¼ inch, is conveyed to cyclone barrel 2 through a coal chute 3. Secondary combustion air is added to cyclone barrel 2 in a tangential manner under excess air conditions to combust the coal and produce flue gases that contain products of combustion, including gaseous species of the oxides of nitrogen. Primary and tertiary combustion air (not shown in FIG. 3) are also added to cyclone barrel 2. The ground coal supplies about 60 to about 95 percent of the heat input to cyclone boiler 1. While FIG. 3 shows the CWS feed lines for the co-firing injection options going into only one cyclone barrel 2, it should be understood that the CWS could be fed to the other cyclone barrel, or additional cyclone barrels if present, in the same manner.

The coal water slurry used in the present invention may be prepared by a variety of methods known to those skilled in the art and from a variety of sources. For example, the coal water slurry can be produced from coal preparation plant pond impoundments, using unprocessed high ash-containing coal fines comprising at least about 30 weight percent, and preferably from about 30 to about 60 weight percent ash on a dry basis, or using processed coal fines reduced in ash content to less than about 20 weight percent, and preferably from about 10 to about 20 weight percent ash on a dry basis. The waste coal fines stream from a typical coal preparation plant processing bituminous coal makes up about 4 weight percent of the total raw coal fed. The particle size of the waste coal fines stream is nominally minus 28 mesh. This coal on a dry basis nominally contains from about 30% to about 60% ash and has a dry higher heating value in the range of about 5,000 to about 10,000 BTU/lb. In addition, the coal water slurry can also be produced using processed coal from coal preparation plant coarse refuse, by using the coal fines fraction from coal preparation plants, or by using a sized, ground, or micronized coal produced from wet or dry grinding equipment.

Referring to FIG. 3, a coal water slurry is prepared from a fuel source such as coal pond fines or coarse refuse coal from a coal preparation plant, and is placed in a storage tank 4. The prepared coal water slurry from storage tank 4 supplies from about 5 to about 40 percent of the heat input to cyclone boiler 1. The coal solids content of the coal water slurry may range from about 40 to about 65 weight percent, and preferably from about 45 to about 55 weight percent, with the remaining amount being water (i.e., about 60 to about 35 weight percent water, preferably about 55 to about 45 weight percent water). The coal in the slurry has a particle size up to about 28 mesh.

The coal water slurry in storage tank 4 is directed through a feed line to a slurry pump 5. The slurry pump 5 preferably has a variable speed control so that the rate of coal water slurry injected into cyclone barrel 2 can be controlled as desired. Preferred slurry pumps that can be utilized include a progressive cavity pump, a centrifugal pump, a gear pump, or other positive displacement pumps. The slurry pump 5 controls the rate of injection to produce a desired amount of heat input into cyclone barrel 2 from the coal water slurry. The slurry pump 5 can be controlled so that the CWS rate of injection can be varied to produce from about 5 to about 40 percent of the total heat input.

There are many types of control systems and techniques that can be utilized to vary the rate of CWS injection. For example, the coal water slurry feed control can be tied into the boiler control system to automatically maintain heat input in the desired range. This can be accomplished by the coal feed being maintained at a steady rate while varying the rate of the coal water slurry feed, or the coal water slurry feed being maintained at a steady rate while varying the coal feed rate into the cyclone barrel. In addition, a flow meter can be operatively attached to the coal water slurry feed line into the cyclone barrel, with the cyclone barrel tied into the boiler control system so that as the coal water slurry feed is increased, the coal feed to the cyclone barrel decreases or vice versa.

The slurry pump 5 is employed to pump the coal water slurry to an injection means. As shown in FIG. 4, the injections means includes a lance 6 in communication with cyclone barrel 2 in a first injection option embodiment, or a lance 11 in communication with cyclone barrel 2 in a second injection option embodiment. The slurry pump 5 can optionally be used to pump coal water slurry through both lance 6 and lance 11 according to the third injection option described previously. Although FIG. 4 depicts both lance 6 and lance 11 disposed in cyclone barrel 2, it should be understood that only one of the lances is necessary for the operation of the present invention according to either of the first or second injection options. Thus, cyclone barrel 2 can be provided with either of lance 6 or lance 11, or both together as shown.

The lance 6 is centered axially on the outer end of cyclone barrel 2 and extends into a coal receiving cylinder 12 of cyclone barrel 2 as depicted in FIG. 4. The lance 11 enters a secondary air duct or conduit 30 at an orientation of about 90° from the flow of secondary combustion air indicated by arrow 19. Both lances 6 and 11 are comprised of two concentric pipes, including inner pipes 13 and 14 and outer pipes 15 and 16, respectively. Inner pipes 13 and/or 14 contain the coal water slurry from slurry pump 5, while outer pipes 15 and/or 16 contain the atomizing medium to be mixed with the coal water slurry. At least one dual-fluid atomizing nozzle 17 is attached to the end of lance 6 protruding into the entry of cyclone barrel 2. At least one or more of dual-fluid atomizing nozzles 18 can be attached to the section of lance 11 protruding into secondary air duct 30.

A coal water slurry spray 21 is injected from nozzle 17 and/or nozzles 18 into cyclone barrel 2 as shown in FIG. 4. The atomizing medium employed with nozzle 17 or nozzles 18 can be selected from the group of air, steam, natural gas, an inert gas (such as a combination of $CO_2$ and nitrogen from an inert gas generator), nitrogen gas, or mixtures thereof. Low weight ratios of the atomizing medium to coal water slurry fuel are used, with the ratio of the atomizing medium to the coal water slurry fuel being from about 0.04 to about 0.2 lb/lb, and preferably from about 0.04 to about 0.08 lb/lb. If a mechanical atomizer nozzle(s) is used, the coal water slurry is atomized and injected into the cyclone barrel without the use of an atomizing medium.

As shown in FIG. 4, under the first injection option, the dual-fluid atomizing nozzle 17 is oriented to direct spray 21 toward the wall of cyclone barrel 2, with the spray angle $\alpha$ being from about 0° to about 90°, preferably from about 45° to about 80°, relative to an axial centerline ($CL_1$) along the barrel axis. Under the second injection option, atomizing nozzles 18 are oriented to provide a spray into the secondary air stream, with the spray angle $\beta$ being from about 0° to about 90°, preferably from about 0° to about 45° relative to the centerline ($CL_2$) of the secondary air flow stream. The slurry and atomizing media pressure for the atomizer nozzles utilized may range from about 30 to about 100 psig depending on the degree of atomization required and the penetration desired.

The coal, the primary combustion air indicated by arrow 20, and the secondary combustion air 19 are all introduced tangentially into cyclone barrel 2 to create the cyclone effect. The coal is directed through coal chute 3 into coal receiving cylinder 12 of cyclone barrel 2. The secondary combustion air 19 is directed through secondary air duct 30, and primary combustion air 20 is directed through a primary air duct 32 in communication with coal receiving cylinder 12. The coal and air are swirled toward the inner walls of cyclone barrel 2 where coal combustion takes place through rapid coal/air mixing. Under the first injection option, spray 21 is injected from lance 6 into and co-fired in a central portion of cyclone barrel 2 to create a slightly reducing condition in a central portion of cyclone barrel 2 to form a reducing zone 22. Under the reducing conditions in reducing zone 22, the nitrogen oxides created in large part by the fuel-bound nitrogen will be reduced to diatomic nitrogen through reactions with reducing gas species. Under the second injection option, spray 21 is injected into the secondary combustion air 19 to create a secondary air stream lower in oxygen concentration as it meets the primary coal on the cyclone barrel wall to reduce $NO_X$ emissions. The slag produced in cyclone barrel 2 travels through a slag spout opening 23 into boiler furnace 8 and drains through a slag tap at the bottom of furnace 8.

The swirling hot combustion gases, indicated by arrow 7 in FIG. 4, exit cyclone barrel 2 through a reentrant throat 24 and are directed into boiler furnace 8. As shown in FIG. 3, the hot combustion gases 7, at temperatures of about 3000° F. or greater, flow out cyclone barrel 2 into a combustion zone of boiler furnace 8. These combustion gases 7 cool as they rise due to radiant and convective heat transfer to steam raising tubes located around the walls 9 of furnace 8. The combustion gases 7 then pass through a set of convective heat transfer tubes 10 prior to exiting cyclone boiler 1 as flue gas.

The percentage of coal water slurry fuel co-fired with the ground coal is set by the available slurry resource, up to a maximum percentage set by the combustion temperature of the cyclone barrel. When the percentage of total heat input provided by the coal water slurry is increased, cyclone barrel temperatures are reduced and particulate carryover into the furnace will also increase. There is a maximum rate of coal water slurry co-firing for each cyclone application. The maximum rate is set by the overall cyclone temperature and particulate carryover. As the rate of CWS co-firing is increased, the temperature in the cyclone is reduced due to water evaporation, and a maximum limit for the CWS is reached beyond which the molten ash slag in the cyclone becomes too viscous to flow.

The present invention provides various benefits and advantages, including an economical method and system for using coal preparation plant waste coal by-products. In addition, the invention provides techniques wherein coal water slurry is fired in such a manner as to effect a reduction of nitrogen oxides emissions from cyclone-fired boilers.

The present invention may be embodied in other specific forms without departing from its scope or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A method for disposal of waste coal fines and reduction of nitrogen oxides emissions from a coal-fired cyclone boiler, comprising the steps of:

a. injecting a coal water slurry spray as a co-firing fuel into a cyclone barrel of a coal-fired cyclone boiler, the cyclone barrel including a primary combustion air conduit and at least one secondary combustion air conduit, the coal water slurry spray oriented at an angle of about 0° to about 90° from an axial centerline of the secondary combustion air conduit; and b. firing the coal water slurry at a rate to provide from about 5% to about 40% of the total heat input into the cyclone barrel, and to lower the temperature and oxygen concentration in the cyclone barrel to effect reduction of nitrogen oxides formation.

2. The method of claim 1, wherein the injecting step is performed with at least one dual-fluid atomizer nozzle that uses an atomizing medium to spray the coal water slurry into the cyclone barrel.

3. The method of claim 2, wherein the atomizing medium is selected from the group consisting of air, steam, natural gas, inert gas, nitrogen gas, and mixtures thereof.

4. The method of claim 2, wherein the ratio of the atomizing medium to the coal water slurry fuel is from about 0.04 lb/lb to about 0.2 lb/lb.

5. The method of claim 1, wherein the injecting step is performed with at least one mechanical atomizer nozzle that atomizes the coal water slurry injected into the cyclone barrel.

6. The method of claim 1, wherein the coal water slurry comprises from about 40 wt-% to about 65 wt-% coal and from about 35 wt-% to about 60 wt-% water.

7. The method of claim 1, wherein the coal water slurry is produced from a source selected from the group consisting of processed coal from coal preparation plant coarse refuse, a coal fines fraction from a coal preparation plant, and a sized, ground, or micronized coal produced from wet or dry grinding equipment.

8. The method of claim 1, wherein the coal in the coal water slurry has a particle size up to about 28 mesh.

9. The method of claim 1, wherein the coal water slurry is produced using unprocessed high ash-containing coal fines, comprising at least about 30 wt-% ash on a dry basis, from coal preparation plant pond impoundments.

10. The method of claim 1, wherein the coal water slurry is produced using processed coal fines, reduced in ash content to less than about 20 wt-% on a dry basis, from coal preparation plant pond impoundments.

11. The method of claim 1, further comprising the step of adding a basic material to the coal water slurry in an amount to increase the fluidity of slag produced in the cyclone barrel.

12. The method of claim 11, wherein the basic material is selected from the group consisting of limestone, dolomite, and mixtures thereof.

13. A system for disposal of waste coal fines and reduction of nitrogen oxides emissions from a coal-fired cyclone boiler, comprising:

a. means for directing a coal water slurry used as a first co-firing fuel into a cyclone barrel of a coal-fired cyclone boiler, the cyclone barrel including a primary combustion air conduit and at least one secondary combustion air conduit;

b. means for injecting a coal water slurry spray into the cyclone barrel at a rate to provide from about 5% to about 40% of the total heat input into the cyclone barrel and to lower the temperature and oxygen concentration in the cyclone barrel to effect reduction of nitrogen oxides formation, the coal water slurry spray being injected at an angle of about 0° to about 90° from an axial centerline of the secondary combustion air conduit; and c. means for directing ground coal used as a second co-firing fuel into the cyclone barrel at a rate such that the ground coal provides from about 60% to about 95% of the total heat input into the cyclone barrel.

14. The system of claim 13, wherein the injecting means comprises at least one dual-fluid atomizer nozzle that uses an atomizing medium to spray the coal water slurry into the cyclone barrel.

15. The system of claim 14, wherein the atomizing medium is selected from the group consisting of air, steam, natural gas, inert gas, nitrogen gas, and mixtures thereof.

16. The system of claim 14, wherein the ratio of the atomizing medium to the coal water slurry fuel is from about 0.04 lb/lb to about 0.08 lb/lb.

17. The system of claim 13, wherein the injecting means comprises a mechanical atomizer nozzle that atomizes the coal water slurry injected into the cyclone barrel.

18. The system of claim 13, wherein the coal water slurry comprises from about 40 wt-% to about 65 wt-% coal and from about 35 wt-% to about 60 wt-% water.

19. A system for disposal of waste coal fines and reduction of nitrogen oxides emissions from a coal-fired cyclone boiler, comprising:

a. a storage tank for holding a coal water slurry;

b. a slurry pump in fluid communication with the storage tank;

c. a cyclone barrel operatively attached to a cyclone boiler, the cyclone barrel including a primary combustion air conduit and at least one secondary combustion air conduit; and d. injection means in communication with the slurry pump and the cyclone barrel for introducing a coal water slurry spray as a first co-firing fuel into the cyclone barrel at a rate to provide from about 5% to about 40% of the total heat input into the cyclone barrel and to lower the temperature and oxygen concentration in the cyclone barrel to effect reduction of nitrogen oxides formation, the coal water slurry spray being injected at an angle of about 0° to about 90° from an axial centerline of the secondary combustion air conduit; and e. means for directing ground coal used as a second co-firing fuel into the cyclone barrel at a rate such that the ground coal provides from about 60% to about 95% of the total heat input into the cyclone barrel.

20. The system of claim 19, wherein the injection means comprises a dual-fluid atomizer nozzle that uses an atomizing medium to spray the coal water slurry into the cyclone barrel.

21. The system of claim 20, wherein the atomizing medium is selected from the group consisting of air, steam, natural gas, inert gas, nitrogen gas, and mixtures thereof.

22. The system of claim 19, wherein the injection means is a mechanical atomizer nozzle that atomizes the coal water slurry injected into the cyclone barrel.

23. A method for disposal of waste coal fines and reduction of nitrogen oxides emissions from a coal-fired cyclone boiler, comprising the steps of:

a. injecting at least one coal water slurry spray as a co-firing fuel into a cyclone barrel of a coal-fired cyclone boiler, the coal water slurry spray injected into one or more combustion air streams flowing into the cyclone barrel;

b. firing the coal water slurry at a rate to provide from about 5% to about 40% of the total heat input into the cyclone barrel and to lower the temperature of the cyclone barrel to effect reduction of thermal nitrogen oxides formation; and c. creating a reducing zone in a central portion of the cyclone barrel where the coal water slurry is injected to effect reduction of fuel-bound nitrogen oxides formation.

24. The method of claim 23, wherein the cyclone barrel includes a primary combustion air conduit and at least one secondary combustion air conduit, the coal water slurry spray injected at an angle of about 0° to about 90° from an axial centerline of the secondary combustion air conduit.

25. The method of claim 23, wherein the injecting step is performed with at least one dual-fluid atomizer nozzle that uses an atomizing medium to spray the coal water slurry into the cyclone barrel.

26. The method of claim 25, wherein the atomizing medium is selected from the group consisting of air, steam, natural gas, inert gas, nitrogen gas, and mixtures thereof.

27. The method of claim 25, wherein the ratio of the atomizing medium to the coal water slurry fuel is from about 0.04 lb/lb to about 0.2 lb/lb.

28. The method of claim 23, wherein the injecting step is performed with at least one mechanical atomizer nozzle that atomizes the coal water slurry injected into the cyclone barrel.

29. The method of claim 23, wherein the coal water slurry comprises from about 40 wt-% to about 65 wt-% coal and from about 35 wt-% to about 60 wt-% water.

30. The method of claim 23, wherein the coal in the coal water slurry has a particle size up to about 28 mesh.

* * * * *